US007011730B2

(12) United States Patent
Davis

(10) Patent No.: US 7,011,730 B2
(45) Date of Patent: Mar. 14, 2006

(54) STRUCTURE FOR PROCESS BELT

(75) Inventor: Trent Davis, Mansfield, MA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/334,167

(22) Filed: Dec. 30, 2002

(65) Prior Publication Data

US 2004/0127126 A1 Jul. 1, 2004

(51) Int. Cl.

| | |
|---|---|
| ***D21F 3/02*** | (2006.01) |
| ***B32B 27/04*** | (2006.01) |
| ***B32B 27/06*** | (2006.01) |
| ***B32B 27/40*** | (2006.01) |

(52) U.S. Cl. ..... 162/358.4; 162/901; 428/361; 428/297.4; 428/298.1; 428/299.1; 428/299.4; 428/299.7; 428/300.4; 428/105; 428/109; 428/114

(58) Field of Classification Search ..... 162/203–207, 162/116, 117, 306, 348, 358.4, 900–904; 474/260–264; 428/359, 361, 295.1, 297.4, 428/105–114, 297.7, 298.1, 299.7, 301.4, 428/300.7, 299.1, 299.4, 300.4; 198/844.1
See application file for complete search history.

(56) References Cited

U.S. PATENT DOCUMENTS

| | | | | |
|---|---|---|---|---|
| 3,421,230 | A * | 1/1969 | Ward | 34/95 |
| 4,526,637 | A * | 7/1985 | Long | 156/137 |
| 4,701,368 | A | 10/1987 | Kiuchi et al. | |
| 4,752,519 | A | 6/1988 | Boyer et al. | |
| 4,795,480 | A | 1/1989 | Boyer et al. | |
| 4,944,820 | A | 7/1990 | McCarten | |
| 4,944,844 | A | 7/1990 | Marcinko | |
| 4,946,731 | A * | 8/1990 | Dutt | 428/156 |
| 5,201,978 | A * | 4/1993 | McCarten et al. | 156/154 |
| 5,238,537 | A | 8/1993 | Dutt | |
| 5,298,124 | A | 3/1994 | Eklund et al. | |
| 5,744,237 | A * | 4/1998 | Stanhope | 428/373 |
| 5,753,085 | A * | 5/1998 | FitzPatrick | 162/358.4 |
| 6,027,615 | A * | 2/2000 | Davenport et al. | 162/358.2 |
| 6,174,825 | B1 * | 1/2001 | Dutt | 442/43 |
| 6,319,365 | B1 * | 11/2001 | Inoue | 162/306 |
| 6,383,339 | B1 * | 5/2002 | Gstrein | 162/358.4 |
| 6,419,775 | B1 * | 7/2002 | Gibson et al. | 156/137 |
| 6,440,274 | B1 * | 8/2002 | Ikeda et al. | 162/358.4 |
| 6,447,648 | B1 * | 9/2002 | Slagowski et al. | 162/358.4 |
| 2004/0094282 | A1 * | 5/2004 | Danzler | 162/358.3 |

FOREIGN PATENT DOCUMENTS

| | | |
|---|---|---|
| DE | 40 28 085 C1 | 2/1992 |
| DE | 297 06 427 U1 | 7/1997 |
| DE | 101 51 485 A | 5/2003 |
| EP | 0 877 119 A | 11/1998 |
| EP | 1 116 821 A2 | 9/2000 |
| JP | 59-125869 | 7/1984 |
| JP | 59-125870 | 7/1984 |
| WO | WO 95/16820 | 6/1995 |

* cited by examiner

*Primary Examiner*—Eric Hug
(74) *Attorney, Agent, or Firm*—Frommer Lawrence & Haug LLP; Ronald R. Santucci

(57) ABSTRACT

A method to produce a papermaker's shoe press belt or other industrial process belt and a belt made according to such method. The belt is produced by dispensing a mixture of polymer and staple fiber onto a cylindrical mandrel, by extrusion or by co-extrusion. Preferably, the variation of the concentration and/or orientation of the staple fiber within the polymer is controlled such that the finished belt has desired properties.

28 Claims, 4 Drawing Sheets

12
20
20
10
18
14
18
16

STRUCTURE FOR PROCESS BELT

BACKGROUND OF THE INVENTION

1. Field of the Invention

The present invention relates to industrial process belts. More particularly, the present invention relates to papermaker's process belts, for example the belts used in the pressing section of paper making machines.

2. Description of the Prior Art

During the papermaking process, a fibrous web is formed on a forming fabric by depositing a fibrous slurry thereon. A large amount of water is drained from the slurry during this process, after which the newly formed web proceeds to a press section. The press section includes a series of press nips, in which the fibrous web supported on a press fabric is subjected to compressive forces designed to remove water therefrom. The web finally proceeds to a drying section which includes heated dryer drums around which the web is directed via dryer fabrics. The heated dryer drums reduce the water content of the web to a desirable level through evaporation.

Rising energy costs have made it increasingly desirable to remove as much water as possible from the web prior to its entering the dryer section. The dryer drums are often heated from within by steam and related costs can be substantial especially when a large amount of water needs to be removed from the web.

Traditionally, press sections have included a series of nips formed by pairs of adjacent cylindrical press rolls. In recent years, the use of long or extended press nips has been found to be advantageous over the use of nips formed by pairs of adjacent press rolls. The longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip is formed which can be five to ten times longer in the machine direction than one formed between two press rolls. This increases the so-called dwell time of the fibrous web in the long nip while maintaining the same level of pressure per square inch in pressing force used in a two-roll press. The result of this new long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness at least on the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web. The base fabric of the belt shown in U.S. Pat. No. 5,238,537 may be woven from monofilament yarns in a single- or multi-layer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web. The base fabric may be flat-woven, and subsequently seamed into endless form, or woven endless in tubular form.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

Long nip press belts, such as that shown in U.S. Pat. No. 5,238,537, depending on the size requirements of the long nip presses on which they are installed, have lengths from roughly 13 to 35 feet (approximately 4 to 11 meters), measured longitudinally around their endless-loop forms, and widths from roughly 100 to 450 inches (approximately 250 to 1125 centimeters), measured transversely across those forms.

It will be recognized that the length dimensions of the long nip press belts given above include those for belts for both open- and closed-loop presses. Long nip press belts for open-loop presses generally have lengths in the range from 25 to 35 feet (approximately 7.6 to 11 meters). The lengths (circumferences) of long nip press belts for some of the current closed-loop presses are set forth in the following table:

| | | Length (mm) | |
|---|---|---|---|
| Manufacturer | Belt Type | Diameter (mm) | Circumf.) |
| Valmet | Symbelt Press ™ | 1425 | 4477 |
| | " | 1795 | 5639 |
| | " | 1995 | 6268 |
| Voith | Flex-O-Nip | 1270 | 3990 |
| | " | 1500 | 4712 |
| | Nip-Co-Flex ™ | 1270 | 3990 |
| | " | 1500 | 4712 |
| | Intensa-S | 1270 | 3990 |
| | " | 1550 | 4869 |
| Beloit | ENP-C | 1511 (59.5 inch) | 4748 |
| | " | 2032 (80 inch) | 6384 |

It will be appreciated that the manufacture of such belts is complicated by the requirement that the base fabric be endless prior to its impregnation with a synthetic polymeric resin.

Nevertheless, belts of this variety have been successfully manufactured for some years. However, two lingering problems remain in the manufacturing process.

Firstly, it remains difficult to remove all of the air from the base fabric during the impregnation and coating process. As implied above, air remaining in the woven structure of the base fabric manifests itself as voids in the final belt product. Such voids may allow the lubrication used between the belt and the arcuate pressure shoe to pass through the belt and contaminate the press fabric or fabrics and fibrous web. Such voids may also act as failure initiation sites causing premature failure of the belt due to cracking. As a consequence, it is important to get all air out of the base fabric to achieve its complete impregnation by the synthetic polymeric resin being used.

Secondly, the widely used technique of providing a layer of polymeric resin material on the outside of the belt, and inverting of the belt to place the layer on the inside, has not yielded consistently satisfactory results.

SUMMARY OF THE INVENTION

It is an object of the present invention to provide a solution to the problems that characterize prior construction and methods of manufacturing process belts, and shoe press belts in particular.

It is another object of the invention to provide a process belt and a method for producing a process belt wherein many alternative materials are available for use as the materials that make up the belt.

It is still another object of the invention to provide a method for producing a process belt that is low cost and that can be performed at high speed.

Accordingly, the present invention is directed toward a method to produce a papermaker's shoe press belt or other industrial process belt, and a belt made according to such method, in which the belt is produced by extruding a mixture of polymer and staple fiber, by co-extruding the mixture and/or by dispensing the mixture onto a cylindrical mandrel. Preferably, the variation of the concentration and/or orientation of the staple fiber within the polymer is controlled such that the finished belt has the desired properties.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

A preferred embodiment of the invention will be described in the context of papermaking machine shoe press belts. However, it should be noted that the invention is applicable to process belts used in other sections of a paper machine, as well as to those used in other industrial settings where it is an advantage to have belts that range in their characteristics and that can be quickly and efficiently produced.

Figure 1:
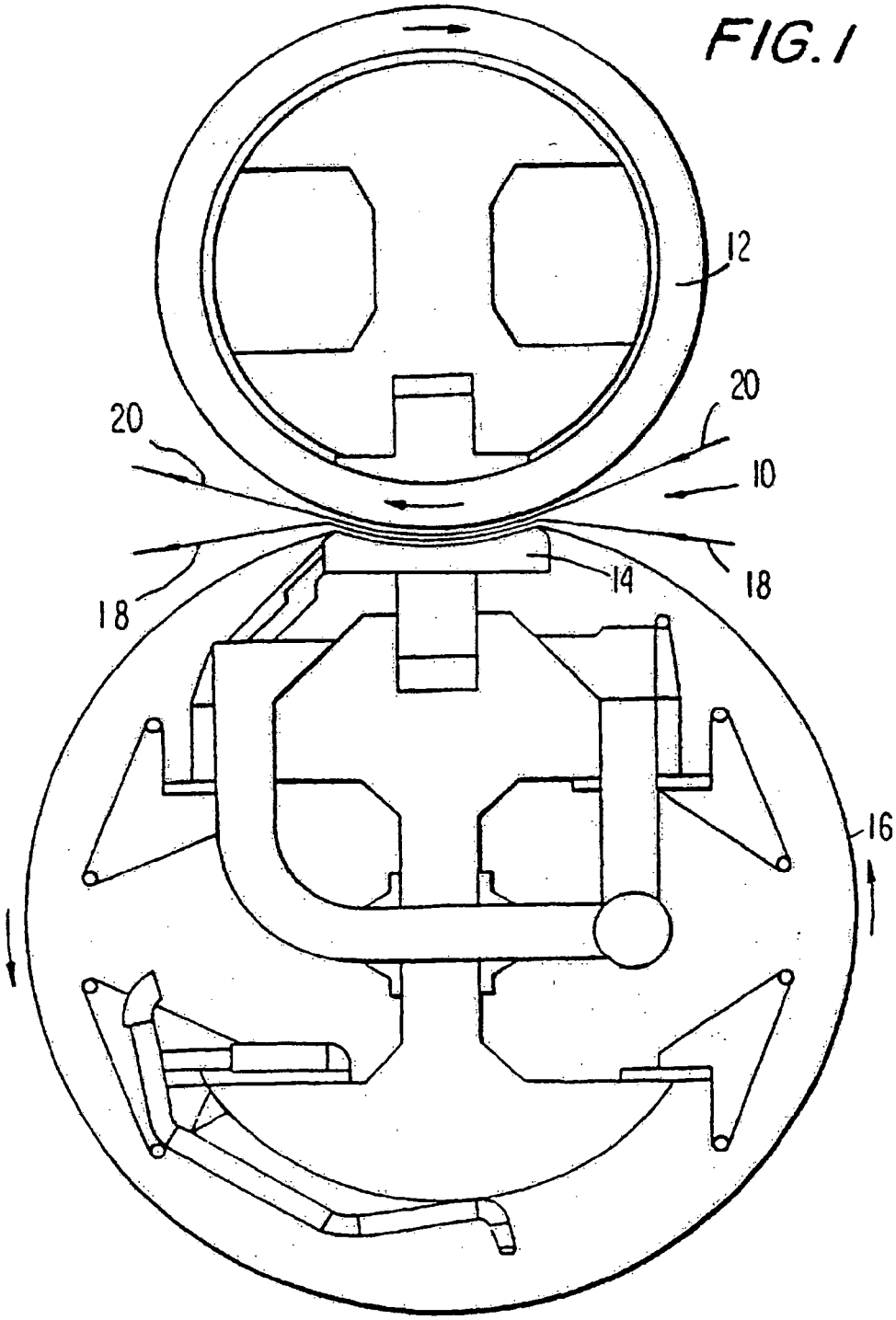
FIG. 1 is a side cross-sectional view of a long nip press.

A long nip press for dewatering a fibrous web being processed into a paper product on a paper machine is shown in a side cross-sectional view in FIG. 1. The press nip 10 is defined by a smooth cylindrical press roll 12 and an arcuate pressure shoe 14. The arcuate pressure shoe 14 has about the same radius of curvature as the cylindrical press roll 12. The distance between the cylindrical press roll 12 and the arcuate pressure shoe 14 may be adjusted by hydraulic means operatively attached to arcuate pressure shoe 14 to control the loading of the nip 10. Smooth cylindrical press roll 12 may be a controlled crown roll matched to the arcuate pressure shoe 14 to obtain a level cross-machine nip profile.

Endless belt structure 16 extends in a closed loop through nip 10, separating press roll 12 from arcuate pressure shoe 14. A press fabric 18 and a fibrous web 20 being processed into a paper sheet pass together through nip 10 as indicated by the arrows in FIG. 1. Fibrous web 20 is supported by press fabric 18 and comes into direct contact with smooth cylindrical press roll 12 in nip 10. Fibrous web 20 and press fabric 18 proceed through the nip 10 as indicated by the arrows.

Alternatively, fibrous web 20 may proceed through the nip 10 between two press fabrics 18. In such a situation, the press roll 12 may be either smooth or provided with void-volume means, such as grooves or blind-drilled holes. Similarly, the side of endless belt structure 16 facing the press fabrics 18 may also be smooth or provided with void-volume means.

In any event, endless belt structure 16, also moving through press nip 10 as indicated by the arrows, that is, counter-clockwise as depicted in FIG. 1, protects press fabric 18 from direct sliding contact against arcuate pressure shoe 14, and slides thereover on a lubricating film of oil. Endless belt structure 16, accordingly, must be impermeable to oil, so that press fabric 18 and fibrous web 20 will not be contaminated thereby.

Figure 2:
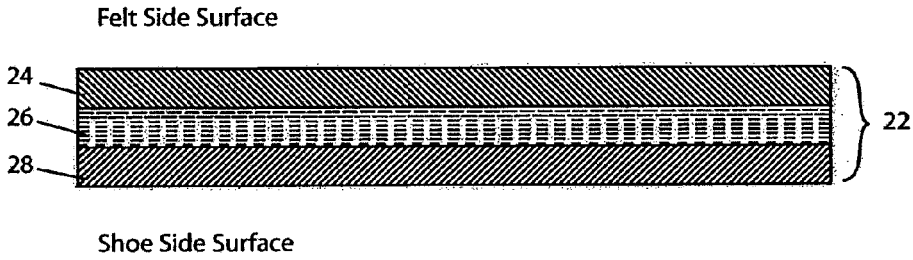
FIG. 2 is a cross sectional view of a preferred embodiment of a process belt material produced according to the present invention.

FIG. 2 is a cross sectional view of a process belt produced according to the invention, which may be used, for example, to manufacture a belt suitable for use as belt 16 of FIG. 1. As can be seen from FIG. 2, belt 22 is made up of 3 layers: a press fabric side polymer layer 24, a staple fiber reinforced polymer layer 26 and a shoe side polymer layer 28. The press fabric side polymer layer is constructed so as to provide the desired characteristics of the material that will contact the press fabric, while the shoe side polymer layer is constructed so as to provide the desired characteristics of the belt surface that will contact the pressure shoe. The staple fiber reinforced polymer layer is used to impart other characteristics to the belt, such as the required tensile modulus. The average length of the individual pieces of staple fiber is a design choice that may be implemented in light of this disclosure. However, it is envisaged that the average fiber lengths will fall within the range of 12 mm to 200 mm.

It should be noted that a multi-layer belt construction is preferable but not necessary to the invention. Any number of layers may be employed. For example, a single layer belt made up a staple fiber reinforced polymer may be produced. In such a belt, it is preferable to vary the concentration of fibers through the thickness of the belt such that the concentration of fiber is higher at the center of the belt than at the press fabric and pressure shoe contacting surfaces. Further, concentrating the fibers at the center of the belt makes the belt relatively pliant near its surfaces, an advantage for a belt that may be turned inside out. More specifically, the preferred variation of concentration is: 0% by volume at the first surface to a maximum percent at the center and back to 0% at the second surface. Overall, the fiber content of the belt ranges from 10% to 50% by volume.

In the single layer belt, it is further preferable to orient the fibers such that they are parallel or substantially parallel with the belt surfaces and not oriented through its thickness. That is, the fibers are preferably oriented in a direction parallel or substantially parallel to fibrous web contacting surface of the belt and the shoe side surface of the belt. In this manner, smoother contacting surfaces are formed and it is less likely that foreign matter could penetrate the belt surface through weak spots that run along the fiber paths.

Referring back to the multi-layer embodiment, it is noted that any number of the layers may include staple fiber. For example, a three layer embodiment similar to that shown in FIG. 2 may be constructed in which each of the two surface layers and the center layer include staple fiber, with the concentration of staple fiber being lower in the surface layers than in the center layer with the fibers having a preferred orientation in MD, CD or even through the thickness in any layer.

The belt of FIG. 2, and of the invention in general, is produced by dispensing a mixture of polymer and staple fiber onto a cylindrical mandrel, by extrusion or by co-extrusion. In any case, the use of liquid polymer systems is preferred. A liquid system may employ either reactive liquids which become solid through chemical reaction, or melted liquids which solidify through cooling. The use of liquid polymer systems has advantages including easier fiber distribution within the matrix and better bond integrity between discreet layers. Further, liquid systems allow for the use of polymers such as polyurethane which offers superior technical properties in many applications. Nevertheless, co-extrusion does have its advantages, the main advantage being that co-extrusion allows for extremely good inter-layer bonding. Also, it is possible to co-extrude the entire belt resin structure from thermoplastic materials, or belt resin material could be extruded in a ribbon format, perhaps in a spiral fashion, or alternatively in a cylindrical fashion.

Regardless of the production technique used, it is preferred that the variation of the concentration and/or orientation of the staple fiber within the polymer is controlled such that the finished belt has desired properties. Control of the concentration and/or orientation of the staple fiber is achieved through modulation of the flow conditions (geometry, speed and duration) of the polymer-staple mix. This is possible since fibers tend to align along the direction of flow, and the principle is equally applicable in any of the mandrel-based or extrusion based embodiments.

Figure 3:
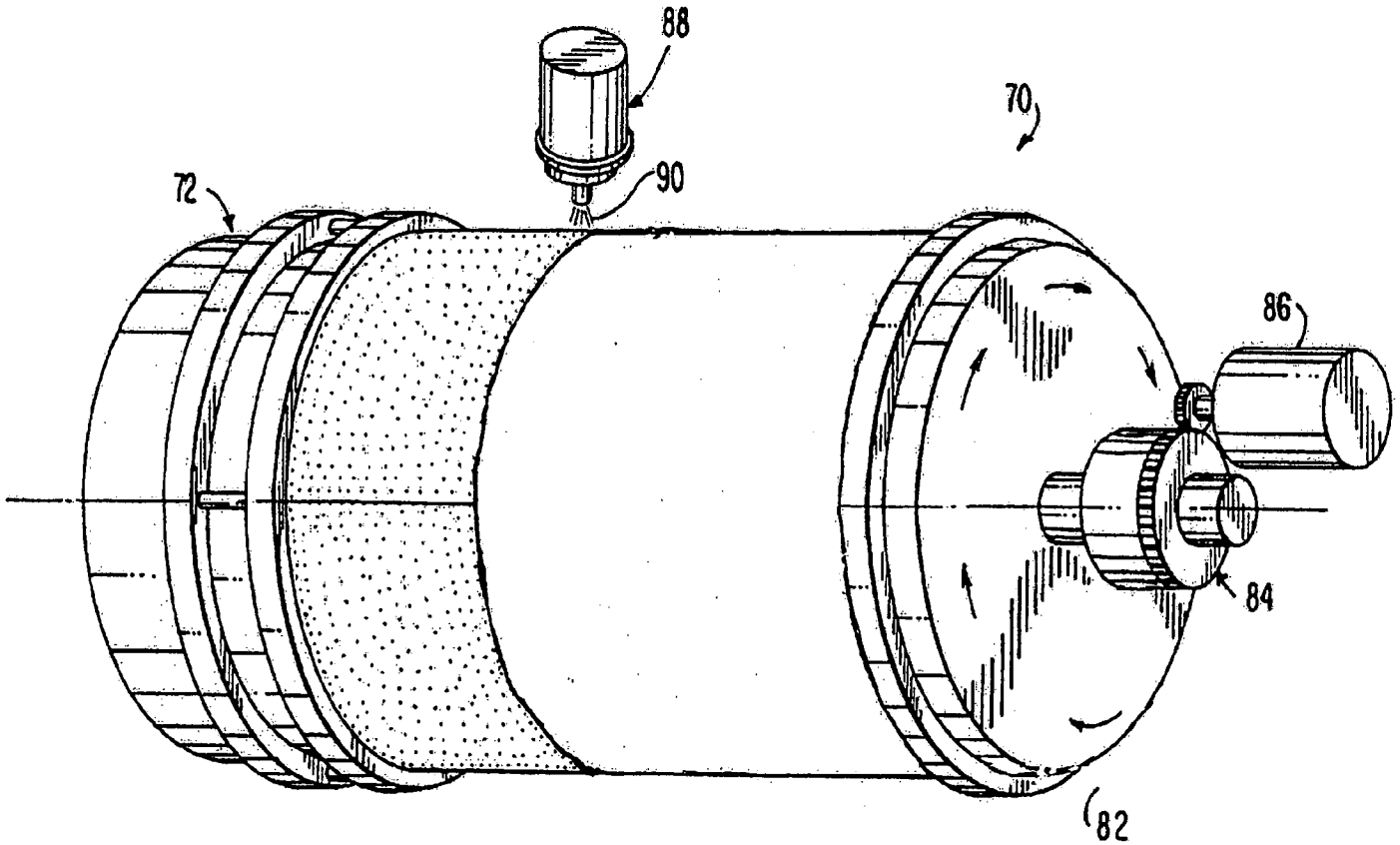
FIG. 3 is a perspective view of an example of a mandrel apparatus which may be used in the manufacture of a process belt according to the present invention.

FIG. 3 illustrates mandrel-type production of a belt according to the invention. As shown in FIG. 3, a production apparatus 70 comprises for example a cylindrical process roll or mandrel 72 having a smooth and polished surface, a gear 84 and motor 86. Preferably, the surface of mandrel 72 is coated with a material, such as polyethylene, polytetrafluoroethylene (PTFE) or silicone, which will readily release a polymer material cured thereon.

During operation, the mandrel 72 is disposed so that its axis is oriented in a horizontal direction, and is rotated about that axis by motor 86 and gear 84. A dispenser 88 of polymer material, or polymer material plus staple fiber mix, is disposed about the horizontally oriented mandrel 72, and applies the polymer material or mix onto the mandrel, or prior formed layer, substantially at the topmost point of the rotating mandrel.

The polymer may be polyurethane, and preferably is a 100% solids composition thereof. The use of a 100% solids system, which by definition lacks a solvent material, enables one to avoid the formation of bubbles in the polymer during the curing process through which it proceeds following its application on the mandrel.

The mandrel 72 is disposed with its longitudinal axis oriented in a horizontal direction, and rotated thereabout. A stream 90 of polymer or polymer/staple mix is applied to the outside of the mandrel, or prior layer, by starting at one end of the mandrel 72 and by proceeding longitudinally along the mandrel 72 as it rotates. The dispenser 88 is translated longitudinally above the mandrel 72 at a pre-selected rate to apply the polymer or mix in the form of a spiral stream. As long as the polymer or mix meets a minimum viscosity requirement, it can be coated onto the mandrel at high speed without dripping.

Further, in an alternate embodiment of the present invention, two streams of polymer material or polymer/staple mix can be applied from two dispensers 88, one stream being applied over the other to form two layers simultaneously. One possible use of such an approach is to have a first stream of polymer material without staple fiber and a second stream of polymer material plus staple fiber mix. In this manner, a two layer belt having a fiber reinforced layer and a non-fiber reinforced layer can be produced using a one-shot technique. Other multiple stream embodiments will be apparent to one of ordinary skill in the art when considered in light of this disclosure.

Figure 4:
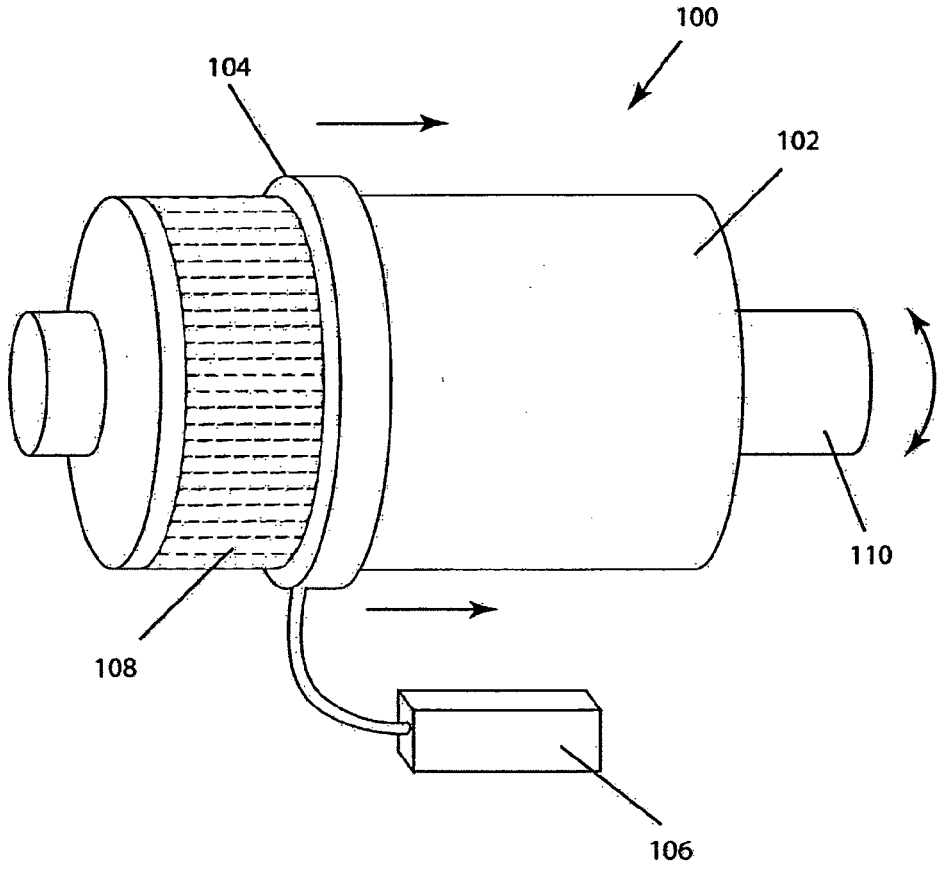
FIG. 4 is a perspective view of another example of a mandrel apparatus which may be used in the manufacture of a process belt according to the present invention.

FIG. 4 illustrates an alternative embodiment of mandrel-type production of a belt in accordance with the invention. As can be seen from FIG. 4, a production apparatus 100 comprises for example a cylindrical process roll or mandrel 102 having a smooth and polished surface. An extrusion annulus 104 is positioned around the mandrel and is attached to processing equipment 106. In operation, the processing equipment is filled with the polymer or polymer/staple mix which is then extruded about the mandrel by the annulus. The polymer material or mix can be extruded directly about the mandrel, or about a prior formed layer.

In FIG. 4, the annulus ring is shown moving from left to right as indicated by arrows and the extruded material is denoted by reference numeral 108. In the FIG. 4 embodiment, it is possible to produce a layer or layers having staple fibers oriented in a direction angular to an axis of the mandrel 110. For example, such a layer could be produced by placing a polymer/staple mix in the processing equipment and rotating the mandrel about axis 110 as the annulus slides from left to right extruding the mix.

Belt production according to the present invention possess several advantages. For one, there are several alternative materials that may be used as the polymer and several alternative materials that may be used as the reinforcing fiber. Examples of suitable polymers include thermoplastic polymers, thermosetting polymers and reactive polymers (heat and addition cured). Examples of suitable fiber materials include glass, polyaramid, carbon, polyester, and polyethylene.

Another advantage of belt production according to the invention is that it is relatively efficient. Preferably, the production process involves sequential coating of the various layers onto a support surface such as a cylindrical mandrel, or coating of more than one layer simultaneously such as in a co-extrusion process. Forming the belt in this manner allows for a very fast production process that can be accomplished using simple, low cost equipment. The time required for such production is on the order of a few hours.

Generally, the belt production process of the present invention involves coating the discrete layers, curing (if required) and final finishing, which differs significantly from the previous techniques of producing a woven or non-woven substrate and subsequently coating or impregnating the substrate with a filler material. Accordingly, the process of the invention may be referred to as a "one-shot" process.

Modifications to the present invention would be obvious to those of ordinary skill in the art in view of this disclosure, but would not bring the invention so modified beyond the scope of the appended claims.

What is claimed is:

1. A process belt comprising a first layer made up of polymer material reinforced with staple fiber and a second layer made up of polymer material that does not include staple fiber;

wherein structural support for said process belt is provided by said staple fiber in said first layer.

2. A process belt as claimed in claim 1, further comprising a third layer of polymer material that does not include staple fiber, wherein said first layer is located between said second layer and said third layer.

3. A process belt as claimed in claim 1, wherein said polymer material comprises one or more materials selected from the group consisting of thermoplastic polymers, thermosetting polymers and reactive polymers.

4. A process belt as claimed in claim 1, wherein said polymer material comprises polyurethane.

5. A process belt as claimed in claim 1, wherein said staple fiber comprises one or more materials selected from the group consisting of glass, polyaramid, carbon, polyester and polyethylene.

6. A process belt comprising a first layer made up of polymer material reinforced with staple fiber and a second layer made up of polymer material that does not include staple fiber, wherein the concentration of said staple fiber is varied through the thickness of said first layer such that the concentration of fiber at one of the top surface and bottom surface of said first layer is 0% by volume and the concentration of fiber at the center of said first layer is greater than 0% by volume.

7. A process belt as claimed in claim 2, wherein the concentration of said staple fiber is varied through the thickness of said first layer such that the concentration of fiber at the top surface and bottom surface of said first layer is 0% by volume and the concentration of fiber at the center of said first layer is greater than 0% by volume.

8. A method for producing a process belt comprising the steps of:

dispensing a first layer made up of polymer material reinforced with staple fiber onto a mandrel; and dispensing a second layer made up of polymer material that does not include a staple fiber onto said first layer.

9. A method as claimed in claim 8, wherein the concentration of said staple fiber is varied through the thickness of said first layer such that the concentration of fiber at one of the top surface and bottom surface of said first layer is 0% by volume and the concentration of fiber at the center of said first layer is greater than 0% by volume.

10. A method as claimed in claim 9, wherein the concentration of said staple fiber is varied through the thickness of said first layer such that the concentration of fiber at the top surface and bottom surface of said first layer is 0% by volume and the concentration of fiber at the center of said first layer is greater than 0% by volume.

11. A method as claimed in claim 8, further comprising a third layer of polymer material that does not include staple fiber, wherein said first layer is located between said second layer and said third layer.

12. A method as claimed in claim 8, wherein said polymer material comprises one or more materials selected from the group consisting of thermoplastic polymers, thermosetting polymers and reactive polymers.

13. A method as claimed in claim 8, wherein said polymer material comprises polyurethane.

14. A method as claimed in claim 8, wherein said staple fiber comprises one or more materials selected from the group consisting of glass, polyaramid, carbon, polyester and polyethylene.

15. A method for producing a process belt comprising the steps of:

extruding a first layer made up of polymer material reinforced with staple fiber onto a mandrel; and extruding a second layer made up of polymer material that does not include a staple fiber onto said first layer.

16. A method as claimed in claim 15, wherein the concentration of said staple fiber is varied through the thickness of said first layer such that the concentration of fiber at one of the top surface and bottom surface of said first layer is 0% by volume and the concentration of fiber at the center of said first layer is greater than 0% by volume.

17. A method as claimed in claim 16, wherein the concentration of said staple fiber is varied through the thickness of said first layer such that the concentration of fiber at the top surface and bottom surface of said first layer is 0% by volume and the concentration of fiber at the center of said first layer is greater than 0% by volume.

18. A method as claimed in claim 15, further comprising a third layer of polymer material that does not include staple fiber, wherein said first layer is located between said second layer and said third layer.

19. A method as claimed in claim 15, wherein said polymer material comprises one or more materials selected from the group consisting of thermoplastic polymers, thermosetting polymers and reactive polymers.

20. A method as claimed in claim 15, wherein said polymer material comprises polyurethane.

21. A method as claimed in claim 15, wherein said staple fiber comprises one or more materials selected from the group consisting of glass, polyaramid, carbon, polyester and polyethylene.

22. A method for producing a process belt comprising the step of co-extruding a first layer of polymer material reinforced with staple fiber and a second layer of polymer material that does not include staple fiber.

23. A method as claimed in claim 22, wherein the concentration of said staple fiber is varied through the thickness of said first layer such that the concentration of fiber at one of the top surface and bottom surface of said first layer is 0% by volume and the concentration of fiber at the center of said first layer is greater than 0% by volume.

24. A method as claimed in claim 23, wherein the concentration of said staple fiber is varied through the thickness of said first layer such that the concentration of fiber at the top surface and bottom surface of said first layer is 0% by volume and the concentration of fiber at the center of said first layer is greater than 0% by volume.

25. A method as claimed in claim 22, further comprising the step of incorporating a third layer into said process belt, said third layer being made up of polymer material that does not include staple fiber, and said first layer being located between said second layer and said third layer.

26. A method as claimed in claim 22, wherein said polymer material comprises one or more materials selected from the group consisting of thermoplastic polymers, thermosetting polymers and reactive polymers.

27. A method as claimed in claim 22, wherein said polymer material comprises polyurethane.

28. A method as claimed in claim 25, wherein said staple fiber comprises one or more materials selected from the group consisting of glass, polyaramid, carbon and polyester and polyethylene.

* * * * *